United States Patent [19]

Hoffman et al.

[11] Patent Number: 4,716,260

[45] Date of Patent: Dec. 29, 1987

[54] PUSHING AND PULLING CABLE

[75] Inventors: Ernest G. Hoffman, Middlefield; David H. Neuroth, Hamden, both of Conn.

[73] Assignee: Hubbell Incorporated, Orange, Conn.

[21] Appl. No.: 896,011

[22] Filed: Aug. 13, 1986

[51] Int. Cl.[4] ..... H01B 7/18

[52] U.S. Cl. ..... 174/102 R; 174/103; 174/106 R; 174/109; 174/117 F

[58] Field of Search ..... 174/102 R, 103, 106 R, 174/108, 109, 117 F

[56] References Cited

U.S. PATENT DOCUMENTS

| | | | |
|---|---|---|---|
| 2,081,634 | 5/1937 | McNamee | 174/115 |
| 2,544,233 | 3/1951 | Kennedy | 174/116 |
| 3,679,812 | 7/1972 | Owens | 174/108 |
| 3,832,481 | 8/1974 | Boyd et al. | 174/102 R |
| 3,843,829 | 10/1974 | Bridges et al. | 174/36 |
| 3,889,049 | 6/1975 | Legg et al. | 174/102 R |
| 4,081,602 | 3/1978 | Paniri et al. | 174/103 |
| 4,196,307 | 4/1980 | Moore et al. | 174/47 |
| 4,262,703 | 4/1981 | Moore et al. | 138/115 |
| 4,284,841 | 8/1981 | Tijunelis et al. | 174/102 R |
| 4,315,099 | 2/1982 | Geradot et al. | 174/47 |
| 4,374,530 | 2/1983 | Walling | 138/110 |
| 4,445,593 | 5/1984 | Coleman et al. | 187/1 R |
| 4,453,035 | 5/1984 | Neuroth | 174/103 |
| 4,453,036 | 6/1984 | Neuroth | 174/103 |
| 4,454,377 | 6/1984 | Neuroth | 174/103 |
| 4,490,577 | 12/1984 | Neuroth | 174/103 |
| 4,567,320 | 1/1986 | Neuroth et al. | 174/103 |
| 4,572,926 | 2/1986 | Ganssle et al. | 174/103 |
| 4,609,416 | 9/1986 | Himmelberger et al. | 174/103 X |
| 4,644,094 | 2/1987 | Hoffman | 174/47 |
| 4,675,474 | 6/1987 | Neuroth | 174/102 R |

FOREIGN PATENT DOCUMENTS

| | | | |
|---|---|---|---|
| 0066910 | 12/1982 | European Pat. Off. | 174/117 F |
| 834955 | 12/1938 | France | 174/113 R |
| 1250823 | 10/1971 | United Kingdom | 174/136 |

*Primary Examiner*—Morris H. Nimmo

*Attorney, Agent, or Firm*—Jerry M. Presson; Alfred N. Goodman

[57] ABSTRACT

An armored cable structure which converts a plurality of stranded flexible wire ropes for suspending and retrieving the cable structure in a bore hole into members which are also rigid in longitudinal compression and constrained against birdcaging. The converted ropes serve as positively drivable members for forcing the cable structure and any equipment attached to the down-hole end thereof down-hole.

25 Claims, 7 Drawing Figures

PUSHING AND PULLING CABLE

FIELD OF THE INVENTION

The invention relates to a reinforced cable structure for pushing and pulling equipment attached to an end thereof, and is especially constructed for deploying, suspending, operating and retrieving submersible pumps in oil wells. The cable structure in accordance with the invention efficiently converts the components of external driving forces applied to the cable exterior to longitudinal pushing and pulling forces to effect the desired deployment of the cable and its attached equipment in a bore hole or similar environment.

BACKGROUND OF THE INVENTION

Cable structures suitable for hauling and power and signal transmission are typically used in oil wells for the installation, operation and retrieval of electrical submersible pumps. Prior art cable used for this purpose is generally flat and comprises a core of power and hauling lines surrounded by a helically-wound interlocked armor tape.

An example of a prior art cable of this type is disclosed in U.S. Pat. No. 4,644,094 and assigned to the same assignee as the instant application.

To chemically treat bottom hole oil wells, a hollow flexible tubing, which may be composed of steel, is inserted into the well. This tubing serves as the conduit through which an appropriate treatment fluid, such as liquid nitrogen, is able to be injected into the well. A pair of coacting endless traction belts is typically used for driving the tubing into and out of the particular bore hole. This type of drive means normally has its belts oriented vertically, directly above the surface of the bore hole. The tubing is gripped tightly between the coacting belts which rotate to impart axial movement to the tubing. A powered reel is used to store, pay out and accumulate the tubing.

Inasmuch as a source of pushing and pulling forces is available with the coacting traction belts, it would be advantageous to have a cable which could also effectively utilize the traction belts as a means for forcing it and any equipment attached to the cable's down-hole end past obstructions and deviations in the bore hole. To be able to utilize the available drive means effectively, the cable structure preferably should possess the feature of being able to efficiently convert the available drive forces into high-magnitude pushing and pulling forces which can be concentrated along the longitudinal axis of the cable structure and hence, parallel to the desired direction of cable translation. The aforementioned prior art cable lacks this feature.

SUMMARY OF THE INVENTION

An object of this invention is to provide a cable structure which is specially constructed to push and pull equipment attached to one end thereof through the bore hole of an oil well.

Another object of this invention is to provide a cable structure for efficiently converting normal and longitudinally directed force components applied to the cable exterior by coacting drive means into cable pushing and pulling forces.

In accordance with this invention, there is provided a cable structure of flattened cross-sectional shape which efficiently converts compressional and translational drive force components applied to the exterior of the cable structure by drive rollers, endless traction belts and similar drive means to longitudinal cable pushing and pulling forces. This conversion is effected by a vertebrae arrangement of coacting gripping members which force-couple the exterior armor tape to a pair of symmetrically-disposed hauling lines with a good interfacial engagement to achieve high efficiencies of force transfer between the hauling lines and the cable drive means.

The vertebrae formed by the gripping members are bendable with the hauling lines and are longitudinally rigid, with each member increasing the rigidity of the segments of the hauling lines which are gripped thereby. Thus, the symmetrically disposed pairs of gripped segments of the hauling lines form two symmetrical and axially rigid columns for exerting high magnitude pushing forces to the downstream portion of the hauling lines and hence, to the equipment attached to the down-hole end of these lines.

An electrical cable and/or hydraulic line for supplying power to the equipment suspended from the cable is contained within the individually incompressible gripping members, typically centrally thereof, and is thereby protected from the high-magnitude drive forces applied transversely to the gripping members.

Other objects, advantages, and salient features of the present invention will become apparent from the following detailed description, which taken in conjunction with the annexed drawings, discloses preferred embodiments of the present invention.

DRAWINGS

Referring now to the drawings which form a part of this original disclosure:

DETAILED DESCRIPTION OF THE INVENTION

Figure 1:
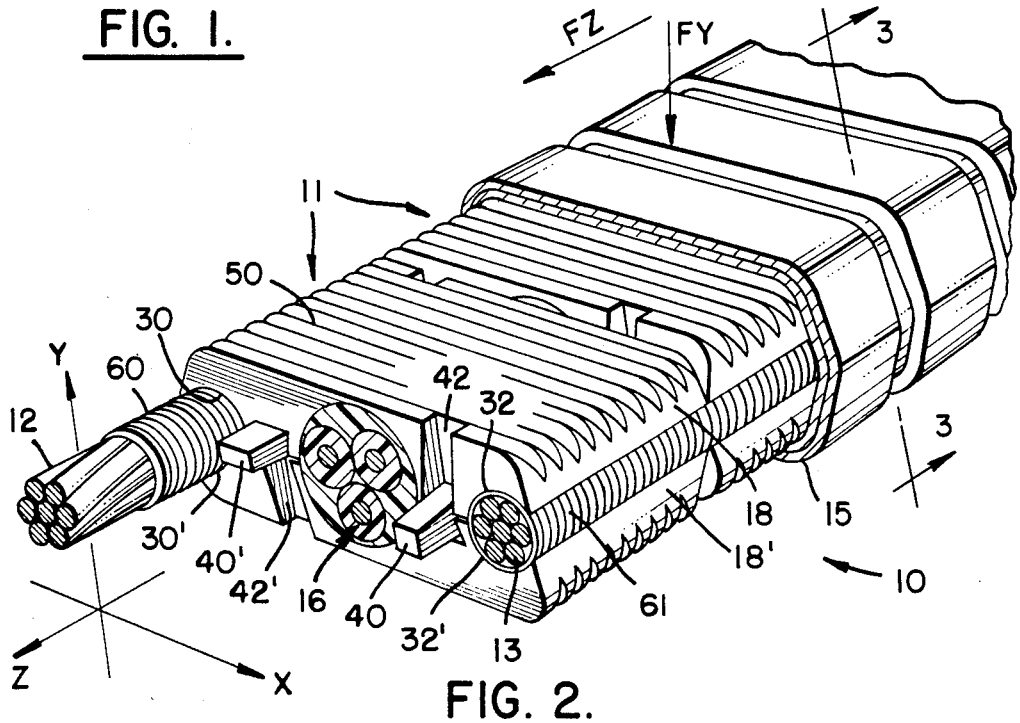
FIG. 1 is a right perspective view with parts broken away of a cable structure constructed in accordance with the principles of the instant invention.

As seen in FIG. 1, the cable structure 10 in accordance with the invention is substantially flat and along its entire length is comprised of a vertebrae assembly formed of longitudinally intercoupled gripping members 11. First and second hauling lines 12 and 13 disposed inside the members 11 form the main tensile members of the structure to which the down-hole equipment is attached and a metallic, interlocked and bendable armor tape 15 which is wrapped around the members 11 for urging them together to tightly grip therebetween the peripheral portion of the hauling lines 12 and 13, and as the exterior protective containment. The members 11 are rigid and durable blocks designed to withstand the high compressive forces applied thereto by the compressive drive means mentioned above and to clamp upon the hauling lines with high compressive force. The members 11 may be formed of metal or a durable plastic material which will resist high temperatures, maintain high mechanical strength and resist oil well chemicals.

Between the first and second hauling lines 12 and 13 and extending parallel thereto inside the members 11 is a protected power conveying line 16 comprised, for example, of a plurality of individually insulated electrical conductors or fluid control lines for the deployed equipment; three such elements being shown and described by the numerals 22, 24, and 26, respectively. The individual elements may be helically wound around each other and form an electrical or hydraulic cable within the cable structure. The protected cable is located centrally of the member 11 and is laterally isolated from the hauling lines 12 and 13 by the intervening rigid body structure of the members 11. In general, the use of hauling lines as tensile members for retrieving flat oil well cable is known and described in U.S. Pat. No. 4,644,094.

An elastomeric filler 28 is applied to the line 16 to fill any voids and valleys between the individual conductors or fluid control lines and the members 11. Preferably, the members 11 are transversely grooved with a series of U-shaped grooves as designated by the numeral 17 in FIG. 4, and the filler 28 selected of a material which can flow into the grooves, 17 and other voids in the members 11 and the armor during assembly. The filler expands and hardens in the grooves and voids when vulcanized to effect a mechanical interlock between the power line and the members 11. The interlock minimizes any longitudinal slippage between the line 16 and the members 11 and blocks gas and chemical flowage between the lines and the vertebrae during usage of the cable structure in an oil well because the vulcanized material again expands into the grooves and voids when the structure is subjected to down-hole elevated temperature conditions.

To ensure that the grooves and voids are filled, an excess quantity of the unvulcanized and soft filler 28 may be applied to the power line filling the valleys between conductors or control lines 22, 24, and 26 and forced under pressure between other voids and other spaces in the members 11 and the interior surfaces of the armor tape 15 holding the members 11. Alternatively, prior to assembly of the members 11, all surface portions of the members may be coated with a slight excess of the unvulcanized filler 28 and the parts then assembled together. The cable structure may be wound onto a reel and vulcanized while on the reel. The vulcanized filler hardens to form a series of annular ribs which mate with the grooves to form a mechanical connection between the cable and the members 11 which prevents slippage of the cable in the vertebrae structure. The elastomeric nature of the filler in its vulcanized state permits long radius bending of the vertebrae structure.

The concept of filling the voids in an armored oil well cable with a vulcanizable elastomeric material is disclosed in U.S. Pat. No. 4,675,474 and is incorporated by reference herein. Because the unvulcanzied filler is typically soft and tacky, before it is applied to the power line 16, the filler may be covered with a thin gauze composed of an open mesh of polypropylene, for example. Once the filler 28 is vulcanized, the cable structure offers good resistance to decompression and crush resistance and better gas and chemical blockage between the power line and the vertebrae. In addition, compressive forces applied to the vertebrae are distributed more uniformly throughout the vertebrae structure thereby reducing points of stress concentration. Filler materials suitable for these purposes may be any of the ethylene-propylene-diene monomer (EPDM) blends or ethylene propylene rubber (EPR) blends disclosed in U.S. Pat. No. 4,675,474 having a Mooney viscosity measured at 212° F. of between 50 and 130. A particularly good filler for this purpose is an ethylene-propylene-diene monomer blend sold by the Kerite Company under the product designation of SP-50.

Figure 2:
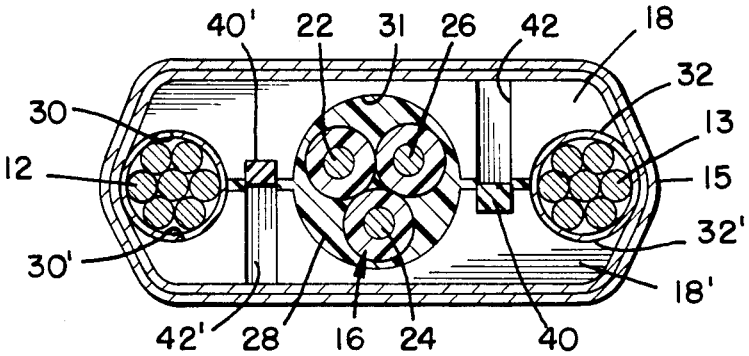
FIG. 2 is a transverse cross-sectional view of the cable shown in FIG. 1.

As seen best in FIGS. 1 and 2, each member 11 is comprised of a pair of opposing upper and lower jaws 18 and 18', respectively which are substantially identical in size and shape and therefore interchangeably usable in the cable structure 10. The jaws 18 and 18', FIGS. 1 and 4, include two pairs of open-sided grooves 30, 30' and 32, 32' which form two juxtaposed pairs of longitudinal, concave gripping surfaces when the jaws are assembled as shown. Each pair of grooves 30, 30' and 32, 32' has a longitudinal length along the Z axis, a transverse radius parallel to the X and Y axes, the X, Y and Z axes being mutually orthogonal, as illustrated in FIG. 1. The Y and Z axes intersect at the mid point of the structure 10. When so assembled and wrapped with the armor tape 15 as illustrated in FIGS. 1 and 2, the groove pairs oppose one another to form rises which clamp the respective hauling lines 12 and 13.

Hauling lines 12 and 13 are, as seen in FIGS. 1 and 2, partially enclosed with a tight fit within oppositely facing, longitudinally extending grooves 30, 30' and 32, 32', respectively, formed essentially identical in size and shape in each member 11. The longitudinal axes of the hauling lines extend parallel to each other and to the Z axis and are centered with respect to the concave surfaces of the groove 30, 30' or 32, 32' by which they are enclosed. The concave surface of each groove is typically circular and circumscribes an arc of about 145 degrees. The radius of each concave surface is slightly greater than the radius of the hauling line 11 or 12 encompassed by that surface. The centers of the oppositely facing groove pairs and their associated hauling lines lie on a common axis parallel to the X axis and are also symetrically located on each side of the Z axis, as best seen in FIG. 2., so that substantially equal compressive forces are applied to each hauling line by the members 11.

Each of the hauling lines is typically formed as a twisted wire rope which in turn is composed of a group of helically wound wire strands to provide the lines with high tensile strength and flexibility. Advantageously, the two wire ropes are helically wound in opposite directions to nullify torque in the cable. The wire ropes, enclosed and clamped by the vertebrae comprised of the members 11, are constrained against buckling and against outward radial separation of the rope strands (birdcaging) by the vertebrae and the enclosing armor tape. The vertebrae and armor essentially convert the wire ropes into a pair of rigid columns capable of exerting substantially equal pushing or compressive forces on the downstream length of cable and hence, on the equipment attached to and abutting the down-hole cable end.

The jaw pairs 18, 18' are constructed as an assembly permitting pivotal movement between successive jaw pairs about the X axis to facilitate long-radius bending of the cable structure about that axis. Down-hole driving of the cable structure is effected by longitudinal movement of each jaw pair along the Z axis in response to the translational force components FY, applied initially to the armor 15 by coacting driving rollers, cleated traction belts and the like. The front and rear end surfaces of the members 11 are acutely angled from the hauling lines, as shown, to permit unobstructed bending between immediately adjacent ones of the members 11 about the X axis.

In accordance with one embodiment, to maintain positional alignment between successive members 11 in the X plane, each pair of jaws 18, 18' may be formed with a projecting tongue 40, 40', respectively, which mates with a groove 42, 42' respectively, in the next adjoining transversely opposite jaw. The grooves 42, 42' have parallel side walls aligned parallel to the Y axis and spaced apart in a direction parallel to the X axis a distance slightly greater than the width of a tongue to facilitate pivotal movement of each pair with respect to its adjacent jaw pair about the X axis. Thus, as seen in FIGS. 2 and 3, each of the tongues 40 in the upper jaws 18 is constrained to slide in a groove 42' in an immediately adjacent lower pair 18', and conversely, each tongue 40' in a lower jaw 18' rides in a groove 42 in the next adjoining upper jaw 18.

Figure 3:
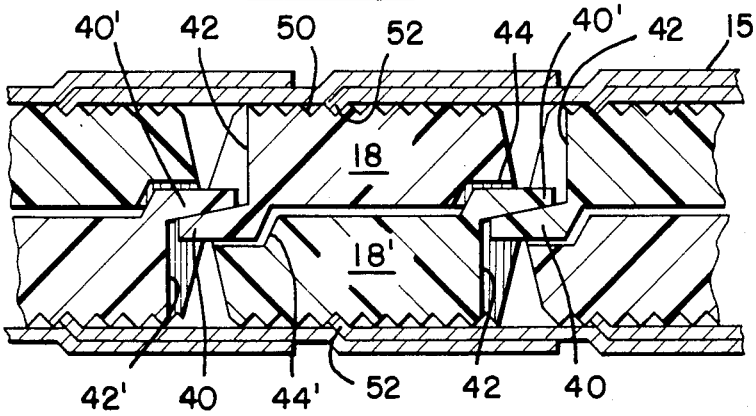
FIG. 3 is a longitudinal cross-section taken along section lines 3—3 in FIG. 1.

As shown in FIG. 3, the tongues 40, 40' project far enough in one direction parallel to the Z axis to overlay respective tongues projecting in a reverse direction from opposite immediately adjacent jaws. One end of each jaw 18, 18' of a jaw pair opposite its tongue end is recessed to accommodate the portion of the tongue projecting inwardmost from its pair; the recesses in the jaw pairs 18, 18' being designated by the numerals 44 and 44', respectively. The recesses 44, 44' are recessed into their respective jaw pairs far enough in a direction along the Y axis to ensure complete accommodation of each tongue when the jaw pairs 18, 18' are compressed close enough in the Y plane to effect the desired gripping of the hauling lines 12 and 13.

As will be evident to those in the art, other types of mechanism and linking arrangements may be employed for pivotally linking the individual members 11 in tandem for long-radius bending with the hauling lines and the armor 15 about the X axis and parallel to the Y axis. For some applications, the aforedescribed longitudinal interconnections between the members 11 may be dispensed with and the members interconnected soley by the intervening segments of the hauling lines.

The thickness of each jaw, that is, the dimension parallel to the Y axis is such that the groove pairs 30, 30' and 32, 32' engage peripheral segments of the hauling lines 12 and 13, respectively, before the opposing flat surface portions of the jaws abut one another. Thus, the groove pairs 30, 30' and 32, 32' can coact to compress therebetween a major portion of the peripheral surfaces of the hauling lines 12 and 13, respectively, and thereby firmly clamp segments of these lines. The jaws are also symmetrical about the X axis so that the wire strands forming each hauling line are compressed radially inwardly substantially equally to more uniformly distribute the compressive gripping forces throughout the entire cross-section of these lines. The outer edges of the members 11 are chamfered to permit the armor tape to overlie the outer peripheral portions of the hauling lines.

The central longitudinal groove 31 is semicircular in cross-section and has a radius slightly greater than that of the power line 16 so that when the flat opposing surfaces of the jaw pairs 18, 18' are forced together to a maximum extent; that is, to a position where they virtually abut one another, the power line is only lightly squeezed by the members 11. Thus, the power line is constrained longitudinally by the members 11 and the filler 28, but is not compressed further to an extent which might cause disruption or injury to this line or to any insulative layer on the line.

To enhance the efficient conversion and transfer of normal and longitudinal drive force components indicated by the respective force vectors FY and FZ in FIG. 1, applied to the armor 15 into longitudinal force components, that is, force components parallel to the Z axis, supplemental intercoupling means may be provided between the armor 15 and the hauling lines 12 and 13.

One such means is provided between the inner surface of the armor 15 and the outer surfaces of the members 11 and is comprised of an inwardly projecting edge portion 52 of each winding which is bent inwardly during the application of the armor to the members to abut lateral V-shaped grooves 50 formed in the exterior surfaces of the members 11. The edge portions 52 are inclined in the direction of the major applied longitudinal force component FZ which is in the pushing direction. By abutting the complementarily inclined surfaces of the grooves 50 with the edge portions 52 of the armor windings, the armor can positively force the members 11 in the downward pushing direction.

Figure 4:
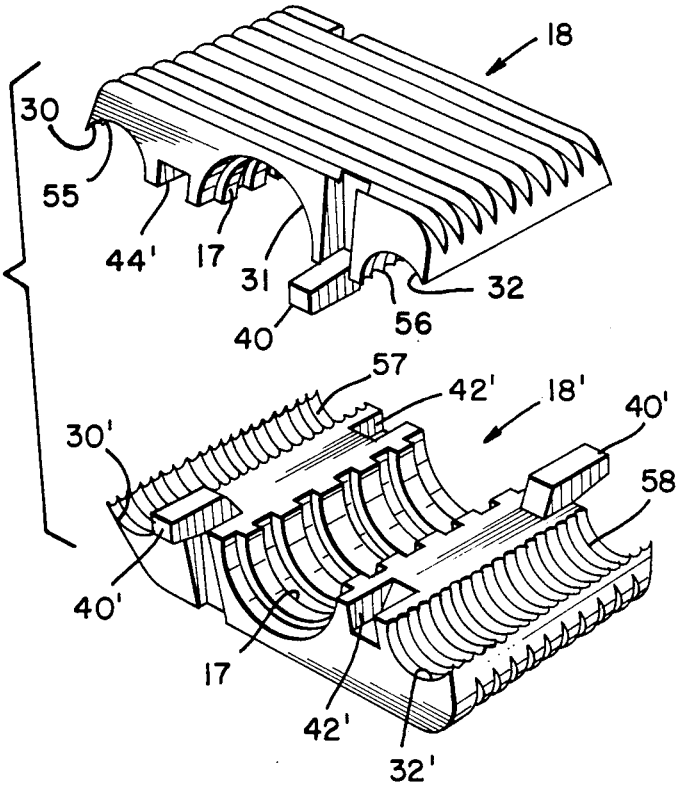
FIG. 4 is an exploded perspective view illustrating the upper and lower jaws forming the gripping members shown in the above Figures.
Figure 5:
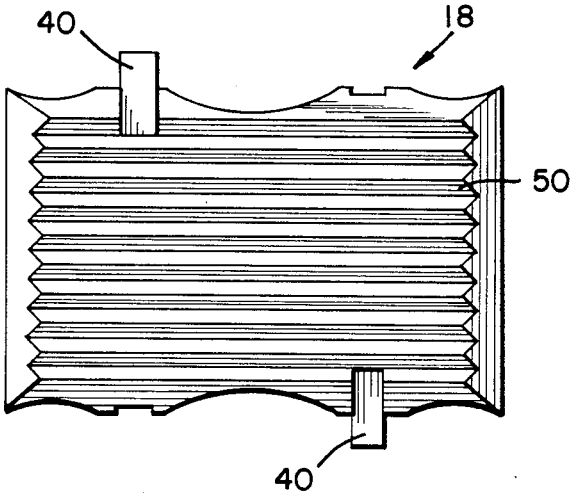
FIG. 5 is a top plan of one of the jaws illustrated in FIG. 4.
Figure 6:
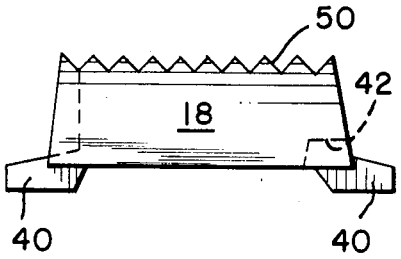
FIG. 6 is an end view of the jaw shown in FIG. 5.

A second means for enhancing the intercoupling of forces from the members 11 to the hauling lines may be provided by a series of grooves 55, 56 formed in the upper jaw 18 and by forming a series of similar grooves 57, 58, respectively, in the lower jaw 18', FIG. 4. The opposing groove pairs 55, 57 and 56, 58 are transversely inclined relative to the Z axis at the same angle as windings 60 and 61 wrapped on the hauling lines 12 and 13, respectively, and have a slightly greater diameter than that of the windings so that the upper and lower halves of each set of windings 60 and 61 nests in a corresponding one of the two grooves of each set. Each winding 60 and 61 is typically a helix formed of a single continuous single strand of wire of circular cross-section wrapped tightly with its convolutions in close or abutting adjacency about the wire ropes forming the lines 12 and 13 respectively. The filamentary windings 60 and 61 form a ribbed peripheral surface to considerably enhance the gripping that can take place between the jaw pairs 18, 18' and the hauling lines 12 and 13. The windings 60 and 61 also serve as the primary means for preventing birdcaging of the strands of the lines about which they are wrapped and additionally increase the longitudinal rigidity of such lines by tightly constraining the individual wire rope strands against bending.

Figure 7:
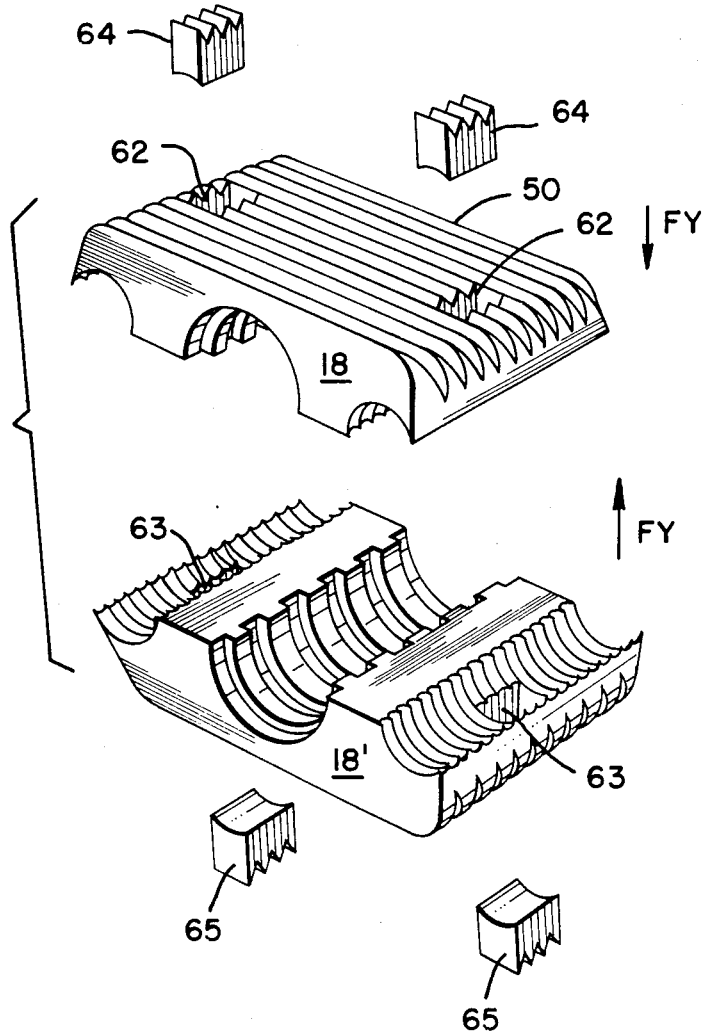
FIG. 7 is an exploded view in elevation depicting a modification of the jaw members shown in FIG. 4.

FIG. 7 illustrates another embodiment of this invention wherein two pairs of supplemental clamping slugs 64 and 65, respectively, are inserted perpendicularly into two pairs of slots 62 and 63, respectively, extending through the grooves 30, 30' and 32, 32', respectively. The slugs are typically composed of a rigid material which may be the same as, or harder than, the material composition of the windings 60 and 61, The slugs may be slidable within the slots 62 and 63, perpendicular to the hauling lines 12 and 13, respectively, to provide discrete high intensity clamping engagements with these lines when the members 11 are subjected to compressive force components FY, and especially localized edge components applied more directly to the lines 12 and 13.

The outer ends of the slugs 64 and 65 are grooved to align with the grooves 50 in the jaws and the inner ends are circular to conform to the peripheral circular surfaces of the lines 12 and 13. If desired, the inner ends of the individual slugs may also be grooved identically to conform to their associated grooves 30, 30', 32 and 32' and thereby positively engage the armor windings.

Once given the above disclosure, many other embodiments, modifications and improvements will become apparent to those skilled in the art. Such other embodiments, improvements and modifications are considered to be within the scope of this invention as defined by the following claims:

What is claimed is:

1. An elongated cable structure having a longitudinal axis and comprising:

an outer layer extending substantially parallel to the longitudinal axis of the cable structure and defining an elongated internal cavity, said outer layer being substantially rigid in longitudinal and transverse directions for receiving longitudinal and transverse components of driving forces when applied to the cable structure and being bendable about said longitudinal axis;

at least one elongated tensile element in said cavity having its longitudinal axis extending substantially parallel to said longitudinal axis of said cable structure and being bendable about said longitudinal axis of said cable structure for pulling and pushing the cable substantially longitudinally;

a plurality of longitudinally disposed gripping members positioned in said cavity between said outer layer and said tensile element; and means coupling said gripping members to said outer layer in a region where said transverse components of driving forces are to be applied to said layer, whereby said members are drive-coupled to said layer, said members substantially enclosing and transversely compressing longitudinal segments of said tensile element to grip and to increase the longitudinal rigidity of such segments, whereby transfer of the driving forces from said outer layer to said tensile element pushing and pulling forces is effected.

2. The structure according to claim 1, wherein each of said gripping members is comprised of opposing and coacting jaw portions enclosing therebetween a substantial portion of the periphery of said tensile element; and wherein said outer layer comprises means for urging said jaw portions together to tightly grip therebetween the peripheral portion of said tensile member.

3. The structure according to claim 2 and further including, means for connecting said gripping members in tandem relationship.

4. The structure according to claim 3, wherein the connecting means includes means for permitting movement of said gripping members relative to one another in a plane transverse to said longitudinal axis of the structure.

5. The structure according to claim 4, wherein said gripping members have a longitudinally extending cavity formed therein for receiving a bendable power conveying line of greater cross-sectional area than that of said tensile element, and further including an elastomeric filler for filling voids in the structure.

6. The structure according to claim 5, wherein the outer surface of said tensile element is transversely ribbed to enhance engagement with said jaw portions of said gripping members.

7. The structure according to claim 6, wherein said jaw portions of said gripping members are transversely grooved to grip the ribbed tensile element.

8. The structure according to claim 5, wherein said outer layer includes windings of armor tape having inwardly projecting edges for engaging said projections or grooves on said gripping members.

9. The structure according to claim 8, wherein said projections or grooves on said members are in substantial alignment with the lay of said windings of armor tape for engaging said inwardly projecting edges of said windings.

10. The structure according to claim 9, wherein said inwardly projecting edges of said windings are inclined in the cable pushing direction.

11. The structure according to claim 3, which further includes an elongated power conveying line disposed in said gripping members inwardly of said tensile element and substantially parallel thereto, and wherein said gripping members are substantially incompressible in transverse cross-section, whereby said power conveying line is protected against transverse forces applied to the cable structure.

12. The structure according to claim 11, wherein there are a plurality of substantially parallel, elongated tensile elements in said cavity positioned adjacent opposite sides of the power conveying line, and further wherein said jaw portions of each of said gripping members coact to grip therebetween said plurality of tensile elements.

13. The structure according to claim 2, wherein said tensile element is formed of a stranded wire rope and further wherein a filamentary winding is wrapped about said wire rope to increase the longitudinal rope rigidity and to inhibit birdcaging of the rope strands.

14. The structure according to claim 13, wherein at least one of said jaw portions has a plurality of grooves extending at substantially equal angles to said longitudinal axis, and further wherein said winding is wrapped helically about the periphery of each of said wire ropes forming a helix angle, the helix angle formed by said winding and said angles of the grooves being substantially equal whereby said winding engages the grooves in said jaw portion to increase the gripping engagement therebetween.

15. The structure according to claim 1, which further comprises further means mounted in at least one of said gripping members and having a rigid, transverse cross-section for increasing the transverse gripping of the one gripping member.

16. The structure according to claim 7, and further comprising, further means mounted in the coacting jaw portions of said one gripping member for increasing the transverse gripping rigidity of said jaw portions.

17. The structure according to claim 15, wherein said further means has an outer end substantially flush with the outer surface of one of said jaw portions.

18. The structure according to claim 17, wherein said outer end of said further means comprises a plurality of transverse grooves or projections in substantial alignment with said grooves or projections, respectively, of said gripping members.

19. A flattened cable having a longitudinal axis and comprising:

a pair of spaced apart wire ropes extending along said longitudinal axis, each wire rope comprising a plurality of helically wound strands having an outer diameter D and being bendable about said longitudinal axis;

an elongated power conveying line located between said pair of wire ropes and extending substantially parallel to said longitudinal axis; and means enclosing longitudinal segments of said wire ropes and said power conveying line for maintaining said wire ropes a fixed distance apart in a lateral direction and having a rigid transverse cross-section for resisting external compressive forces applied in planes transverse to said longitudinal axis, said means comprising a series of pairs of gripping jaws, each jaw pair having oppositely facing, open longitudinal grooves of radii substantially equal to D/2, the grooves in each jaw extending substantially parallel to said axis and being spaced apart laterally substantially the same distance as said ropes, said pairs of jaws being mounted in tandem, spaced apart relationship with other pairs of jaws along said longitudinal axis, opposing grooves in each jaw pair receiving substantially one half of the peripheral portions of a wire rope extending therethrough and gripping such portions of said rope tightly therebetween.

20. The cable structure as claimed in claim 19, wherein the outer surface of said jaws have transverse serrations, and a layer of armor having a plurality of overlapping windings surrounding said jaws, and further wherein the edges of each of the windings closest to said outer surfaces are inclined inwardly to abut the serrations in the direction of pushing forces applied to the cable.

21. The cable according to claim 19, wherein each pair of gripping jaws includes a central open faced groove extending parallel to said longitudinal axis for receiving and at least partially enclosing said power conveying line.

22. In an elongated cable having a longitudinal axis, a layer of armor and means interior of the armor layer, wherein said armor layer comprises:

a plurality of overlapping windings surrounding said means, and further wherein each edge of an overlapped portion of each of said windings depends inwardly from said portion of said winding to engage said means, whereby forces normal and parallel to said longitudinal axis applied to said armor layer are transferred by said edge to said means.

23. A cable structure comprising:

at least one elongated, substantially flexible, tensile element for providing high tensile strength to the structure;

a plurality of force transmitting members of rigid transverse cross-section mounted in succession on said tensile element for transmitting forces applied to the cable structure to said tensile element, each of said members having a plurality of transverse open-sided grooves formed therein having their open sides at least partially enclosing opposite portions of said tensile element; and a plurality of transverse, annular portions affixed to the exterior of said tensile element and having a cross-section conforming to corresponding ones of said grooves in said members, whereby the enclosures of said portions by said corresponding grooves minimize relative axial displacements between said element and said members.

24. The structure according to claim 1, wherein adjacent pairs of said gripping members abut one another.

25. The structure according to claim 1, wherein said gripping members form a series of serially abutting vertebrae.

* * * * *